US007654775B2

(12) United States Patent
Ruckman

(10) Patent No.: US 7,654,775 B2
(45) Date of Patent: Feb. 2, 2010

(54) SOIL NAIL LAUNCHER

(75) Inventor: Timothy Allen Ruckman, Phoenix, AZ (US)

(73) Assignee: R&B Leasing, LLC, Fruita, CO (US)

( * ) Notice: Subject to any disclaimer, the term of this patent is extended or adjusted under 35 U.S.C. 154(b) by 65 days.

(21) Appl. No.: 12/118,426

(22) Filed: May 9, 2008

(65) Prior Publication Data

US 2009/0277943 A1 Nov. 12, 2009

(51) Int. Cl.
*E21D 20/00* (2006.01)
*E21D 21/00* (2006.01)

(52) U.S. Cl. ..... 405/259.1; 405/302.4

(58) Field of Classification Search ..... 405/259.1, 405/259.2, 259.3, 259.4, 259.5, 259.6, 258.1, 405/262, 302.1, 302.4
See application file for complete search history.

(56) References Cited

U.S. PATENT DOCUMENTS 3,807,182 A * 4/1974 Schnabel, Jr. ..... 405/259.1
5,017,047 A * 5/1991 Myles et al. ..... 405/259.1
5,044,831 A 9/1991 Myles et al.
5,114,279 A * 5/1992 Bjerngren et al. ..... 405/259.1
5,913,252 A * 6/1999 Castagner et al. ..... 73/864.45
6,565,288 B1 * 5/2003 McCallion ..... 405/262
6,874,975 B2 * 4/2005 Hilfiker et al. ..... 405/262
7,226,247 B2 * 6/2007 Barrett et al. ..... 405/259.5
7,338,233 B2 * 3/2008 Barrett et al. ..... 405/259.5
7,384,217 B1 * 6/2008 Barrett et al. ..... 405/302.4

FOREIGN PATENT DOCUMENTS

EP 0239258 9/1987
EP 540059 A1 * 5/1993
GB 1580142 11/1980

OTHER PUBLICATIONS

Examination Report issued by the Intellectual Property Office of New Zealand for Patent Application No. 576901, dated May 14, 2009.

* cited by examiner

*Primary Examiner*—Frederick L Lagman
(74) *Attorney, Agent, or Firm*—Sheridan Ross PC

(57) ABSTRACT

A soil nail launching device and method are provided wherein the launching device includes an improved configuration for the protective shroud and an improved configuration for a connection between the breach and barrel of the launching device. For the protective shroud, a plurality of removable shroud plates are provided to ease maintenance of the shroud plate, as well as to provide more consistent pressure release after the launcher has been fired. The improved breach and barrel design includes a connection that does not reduce the area of the annular space that is evacuated during firing of the device, thereby optimizing the available volume of air to be transferred to the breach for launching the soil nail through the barrel.

3 Claims, 6 Drawing Sheets

SOIL NAIL LAUNCHER

FIELD OF THE INVENTION

The present invention relates to systems and methods of stabilizing soil, and more particularly, to a soil nail launcher used to emplace soil nails.

BACKGROUND OF THE INVENTION

In order to stabilize soil and rock formations, it is known to utilize soil nailing in which a plurality of elongate reinforcing members are driven into the ground in an array in order to improve the bulk properties of the surrounding soil and rock.

One reference that discloses a device and method of soil nailing includes the U.S. Pat. No. 5,044,831, the disclosure of which is hereby incorporated by reference.

Two additional examples of references that disclose soil nailing techniques includes the British Patent No. 1,580,142, and the European Patent 0 239 258.

While these references may be adequate for their intended purposes, there is still a need to provide an improved soil nailing device that is easier to maintain, as well as one that is more efficient by having the capability to launch a greater number of soil nails over a period of time.

The portion of the soil nailing device that contacts the ground when a nail is being launched is referred to as the shroud or baffle assembly which enables the distribution of pressure away from the barrel of the launcher, and also captures any fragments that are carried through the barrel, such as the sabot or collett which is attached to the distal tip of the soil nail. As time progresses, the baffle may become clogged with soil or other debris, thereby limiting its ability to effectively release high-pressure from the barrel. The baffle may become damaged over time, thereby also changing it pressure-relieving characteristics. The failure to consistently relieve pressure from the barrel as the nail is launched can negatively affect the depth of the launched nail. Therefore, there is a need to provide an improved design for the baffle to ensure it captures fragments launched from the barrel, yet allows effective pressure release from the barrel.

Another disadvantage of existing soil nailing devices is that it may take an inordinate amount of time to pressurize the device so that a nail can be launched. One type of soil nailing device includes a barrel having a coaxial arrangement of an inner tube/casing and an outer tube/casing. The annular space between the inner and outer tubes is pressurized, and supplies the motive force for launching the soil nail by release of pressure within this annular space into the breach of the barrel. This annular space is pressurized by a source of compressed gas. Preferably, the source of compressed gas includes a plurality of pressurized containers that are stored on a deployment vehicle that transports and secures the launching device. One limiting factor in how quickly soil nails can be launched depends upon the time in which it takes to adequately pressurize the annular space for the next nail to be launched. Because of the noise associated with the launching of a nail, safety requirements for construction along highways and other roads generally require that traffic be stopped during the launching of a nail. The more quickly the soil nails can be launched, the less disruption for traffic flow and of course the more quickly a job can be completed. Therefore, there is also a need to provide a soil nail launching device that has a shorter cycle time in terms of the number of soil nails that can be launched in a period of time.

Additionally, there is also a need to reduce the required pressure to launch a nail, yet still achieving the same depth of penetration for a soil nail that is launched. A reduced pressure requirement will inherently reduce the time to launch successive nails.

BRIEF DESCRIPTION OF THE INVENTION

In accordance with the present invention, an improved soil nail launching device is provided with two primary improvements. The first improvement of the present invention relates to a construction for the shroud that enables adequate pressure distribution from the barrel after a launch, yet minimizes clogging of the shroud by provision of removable shroud plates, thereby easing maintenance efforts.

A second improvement of the present invention relates to an improved barrel construction in which the compressed gas within the annular space between the inner and outer tubes can be more efficiently evacuated into the breach, thereby reducing the actual pressure requirement in the annular space for launching a soil nail to a desired depth. This reduced pressure requirement within the barrel also results in a shorter cycle time for consecutive firing of multiple soil nails at a particular job site. Additionally, the reduced pressure requirement also increases the life of the soil nail launcher by creating less stress on the various seals of the breach and valving that will inherently fail over time and require replacement.

With respect to the first improvement of the present invention, the construction of the shroud has been modified by providing the plurality of removable shroud plates attached to a perforated cage. The removable plates are spaced from one another along the cage, yet have parallel side edges that are closely spaced from one another to prevent escape of fragments exiting the barrel. The plates are easily removed from the cage, thereby easing maintenance efforts in replacing damaged plates and to remove debris around the plates.

With respect to the second improvement of the present invention, the pathway between the annular gap between the tubes of the barrel and the cavity or chamber within the breach has been improved such that the annular gap can be more quickly evacuated during operation, thereby providing an increased volume of air which pressurizes the chamber within the breach, and therefore increases the force by which the soil nail is driven into the soil. More specifically, a connection between the breach and the barrel has been improved such that there is no constriction as the compressed air travels through that connection and then into the chamber of the breach.

Various other features and advantages of the present invention will become apparent from a review of the following detailed description, taken in conjunction with the accompanying drawings.

DETAILED DESCRIPTION OF THE INVENTION

Figure 1:
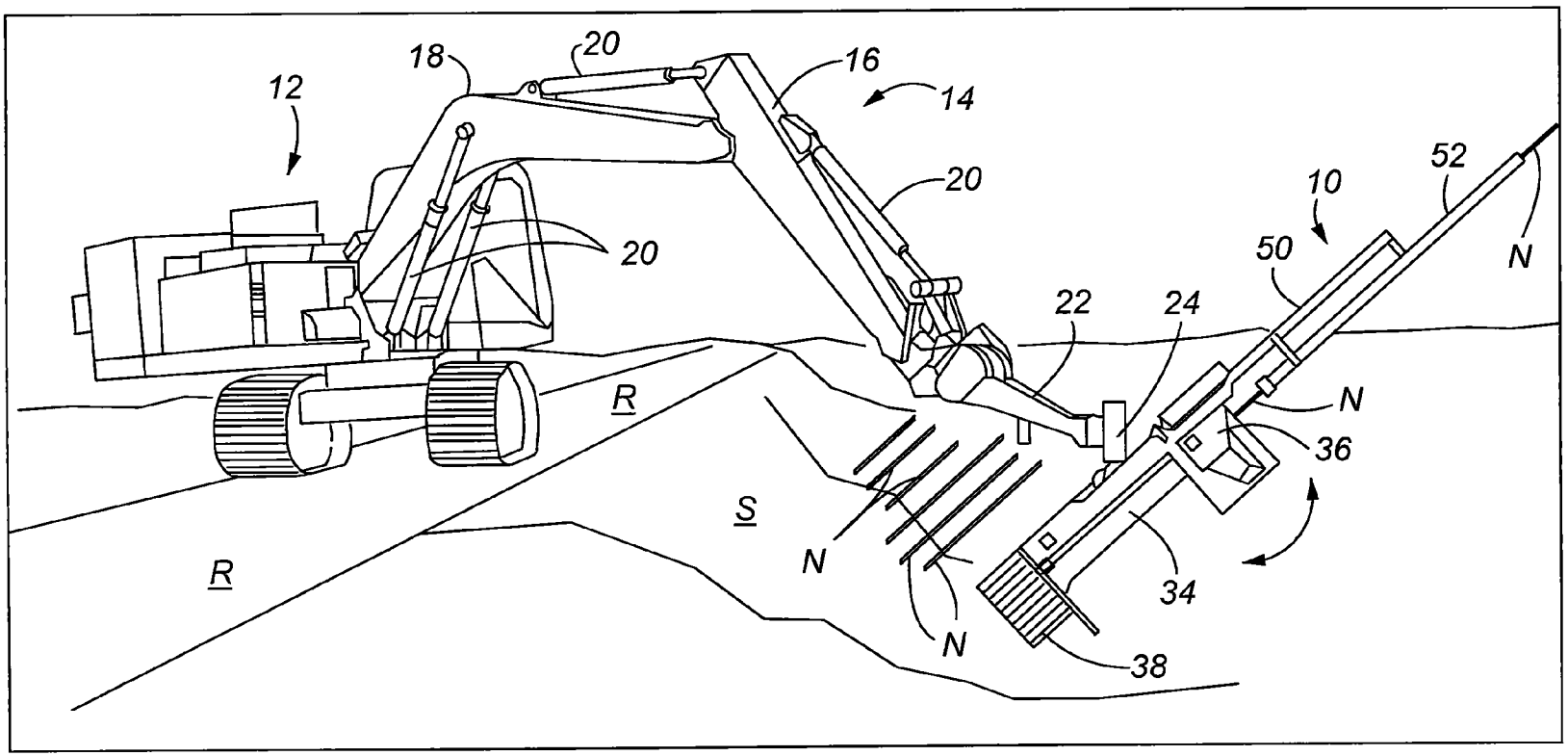
FIG. 1 is a perspective view of a vehicle that transports and supports a nail launching device, and this Figure also shows a plurality of soil nails that have been emplaced in a sloping surface near a road bed.
Figure 2:
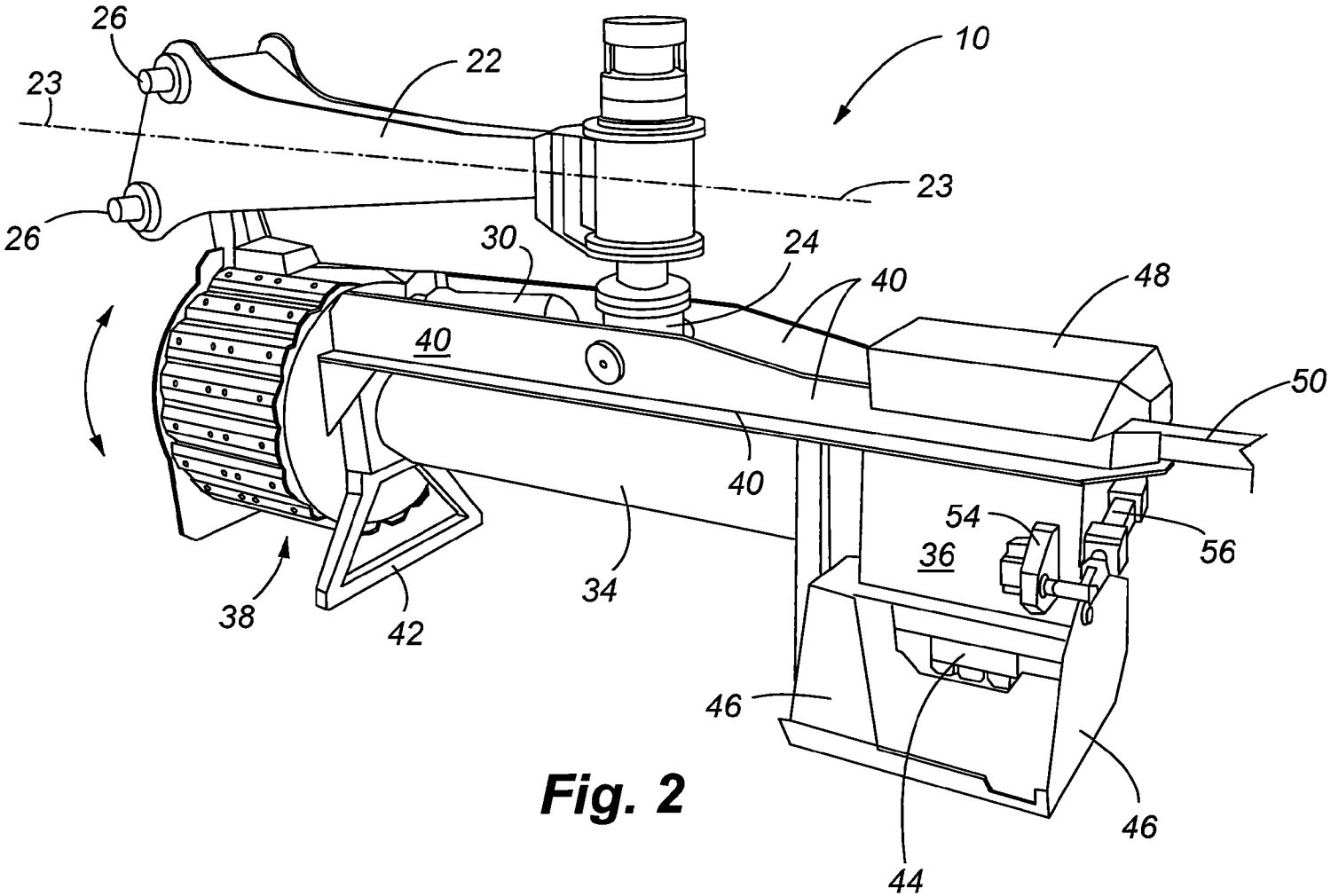
FIG. 2 is a fragmentary perspective view of the soil nail launching device of the present invention.

FIG. 1 illustrates the soil nail launching device 10 of the present invention attached to the boom or articulated arm 14 of a deployment vehicle 12. As shown, a plurality of soil nails N are emplaced in soil S located on a sloping surface adjacent a road bed R. Once all of the nails are emplaced, the protruding ends may be cut to grade. The boom 14 of the deployment vehicle is shown as having two boom segments 16 and 18, and a number of hydraulic cylinders 20 which are used to articulate the boom to a desired position in order to position the launcher 10. As also shown, a boom extension 22 interconnects a distal end of the boom segment 16 to the launching device 10. A boom pivot 24 is provided to enable precise rotational positioning of the launching device 10. Referring to FIG. 2, connection pins 26 of the boom extension are used to connect the extension 22 to the distal end of the boom segment 16. The boom pivot 24 includes a hydraulic cylinder assembly 30 (partially shown) which can adjust the angle at which the launcher 10 extends with respect to the long axis 23-23 of the boom extension 22.

The primary components of the launching device 10 include a barrel 34, a breach 36 located at one end of the barrel and a shroud assembly 38 located at the opposite end of the barrel. A frame 40 comprising a number of angled plates provide a stable mounting for the launcher components. A front support 42 and a rear support 46 allow the launcher to be placed horizontally on the ground when not in use. The rear support 46 also acts as a housing for valve bank 44, as described below. FIG. 2 also illustrates a control box 48 that houses electrical and pneumatic components of the launching device. Various hydraulic and electrical lines have been eliminated in FIG. 2 in order to clarify viewing of the basic components of the launching device.

Figure 3:
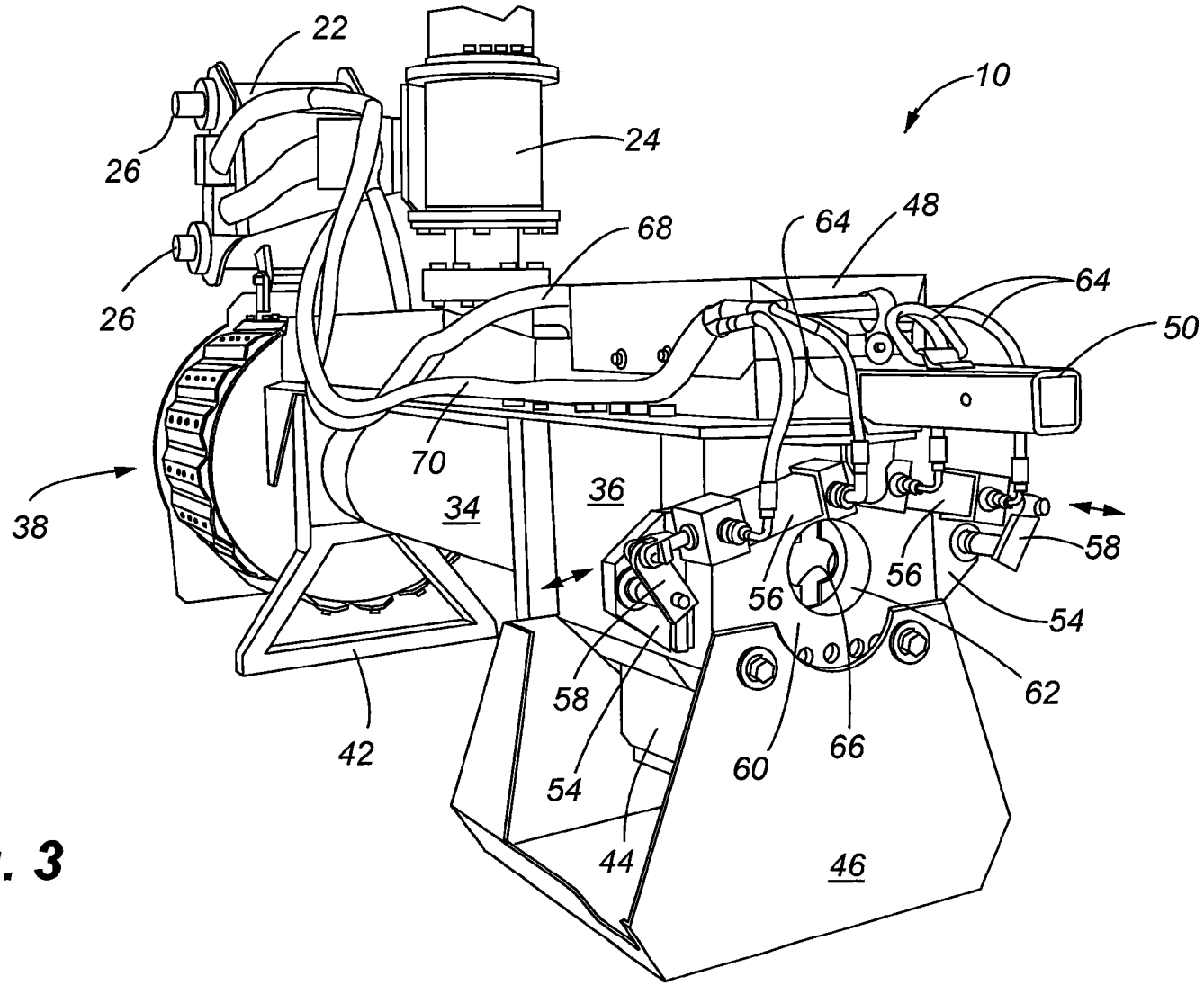
FIG. 3 is another fragmentary perspective view of the soil nail launching device of the present invention.

Now referring to FIG. 3, another perspective view of the launching device is provided, as to include illustration of some of the hydraulic and electrical control lines. In this perspective view, the rear support 46 is shown as having a bottom flat surface which enables the breach 36 and the barrel 34 to be placed in a substantially horizontal position. Referring also to FIG. 1, the back or rear end of the launching device further includes a nail support bracket 50 and a cylindrical nail housing 52 which holds the portion of the soil nail N that protrudes away from the breach 36 when the soil nail is loaded for launching. FIG. 3 also illustrates additional details of the breach to include a pair of breach plates 54 that are operated by a pair of control cylinders 56. Linkage 58 interconnects the pistons of the control cylinders 56 to the protruding ends of the breach plates 54. An aperture 66 is formed by half circular shaped cut-outs that are formed on the abutting ends of the breach plates 54. The aperture 66 is sized to receive a soil nail. A breach plate mounting block 60 is used to mount the breach plates to the breach assembly and the block 60 forms the rear portion of the breach 36. When it is desired to launch a soil nail, the cylinders 52 are operated to separate the plates from one another at the central opening 62 of the mounting block 60. The forward or front end of the soil nail can then be inserted within the breach 36, as explained further below.

Figure 4:
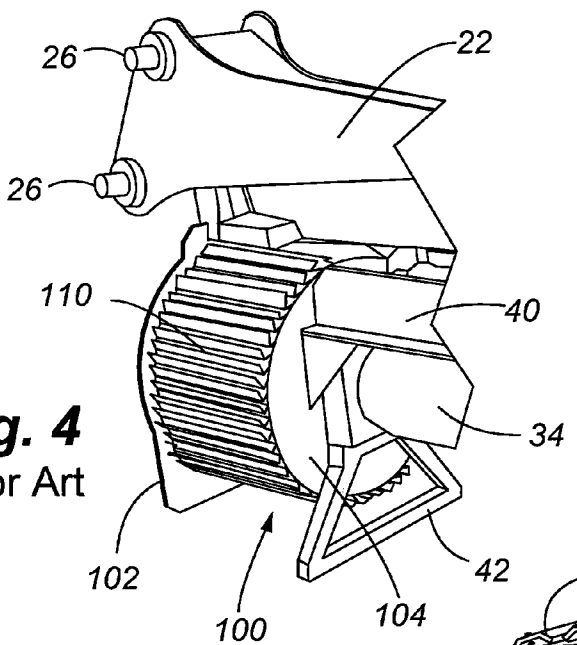
Fig. 4 Prior Art
FIG. 4 is a fragmentary perspective view of a prior art soil nail launching device showing the prior art shroud assembly.

Referring now to FIG. 4, the prior art is shown with respect to a prior art shroud assembly 100. The shroud assembly 100 comprises a base plate 102 that is placed against the ground when the launching device is in operation, a top plate 104, and an interconnecting plurality of deflectors 110 that form a cylindrical shaped cage. A central opening (not shown) is formed in the base plate to enable a launched soil nail to pass through the opening and into the ground. The deflectors 110 are welded at each end to the respective plates 102 and 104. The deflectors 110 are angle iron brackets placed in an overlapping arrangement as shown; each bracket is nested in the gap within the adjacent bracket. This overlapping arrangement allows compressed air to escape through the gaps between the adjacent angle iron brackets. This overlapping arrangement also captures fragments that exit the barrel. One problem associated with the prior art is that the angle iron brackets are permanently welded to the plates 102 and 104 and therefore, it is not possible to remove the angle iron brackets 110 to clean the cage. Subsequently, the gaps between the angle iron brackets become clogged, thus sacrificing the pressure relieving capability of the shroud assembly. This loss in pressure relieving capability results in some additional pressure being maintained within the barrel during launching, which sacrifices the depth to which the nail can be launched into the soil. In order to clean debris caught between the adjacent angle iron brackets, this effort is a time-consuming task and must be done frequently in order to maintain optimizing functioning of the shroud assembly. Bent brackets are not be easily replaced and permanent deformation of the brackets also affects barrel pressure.

Figure 5:
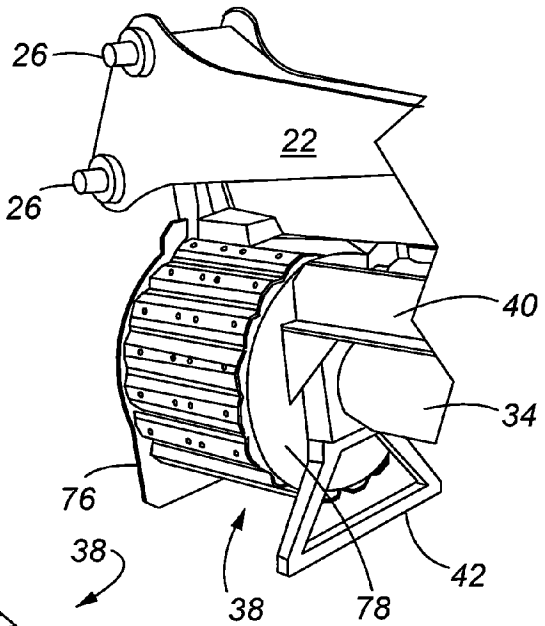
FIG. 5 is an enlarged fragmentary perspective view of the soil nail launcher device of the present invention illustrating the improved shroud assembly.
Figure 6:
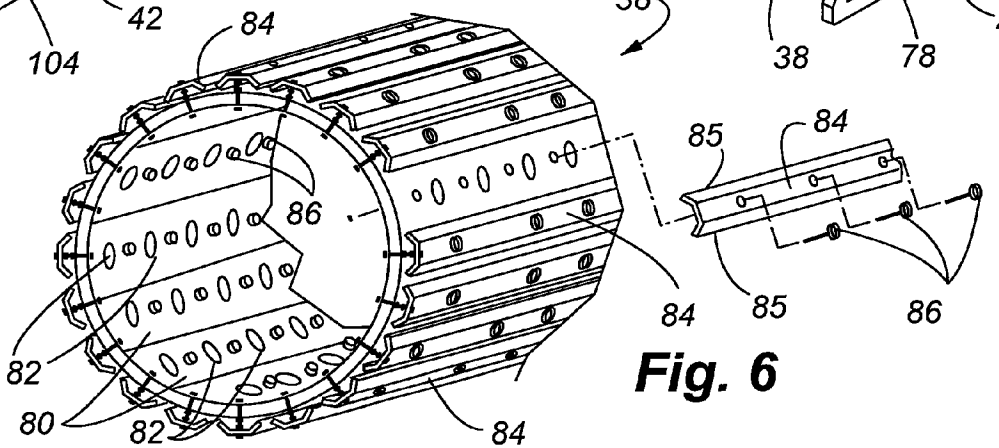
FIG. 6 is an enlarged fragmentary cross-sectional view of the shroud assembly of FIG. 5.

Now referring to FIGS. 5 and 6, an improved shroud assembly 38 is illustrated. The shroud assembly according to the present invention also includes a base plate 76, a top plate 78; however, in lieu of the angle iron elements 110 directly attached to the plates 76 and 78, a cage or cylindrical member 80 interconnects the base plate and top plate. Removable shroud plates 84 are also provided and attach to the cage 80. As shown, the removable shroud plates 84 are placed in a substantially parallel and side-by-side relationship around the periphery of the cage 80. The removable plates 84 are secured to the cage by a plurality of fasteners 86. One or more fasteners are used to secure each removable plate. The orientation of each of the plates is such that they cover a corresponding group of underlying apertures 82 formed in the cage. The removable plates 84 are bent or curved at their opposite side edges 85 thereby forming a U-shape cross-section. Accordingly, the removable plates 84 have opposing side edges 85 that extend closer to the outer surface of the cage, and the interior portion of the removable plates 84 extend further away from the cage as compared to the opposing side edges. In other words, the bend or curve formed in a removable plate 84 is directed radially inwards toward the center of the cage 80.

A slight uniform gap exists between each abutting side edge of adjacent removable plates 84. With this specific arrangement of the removable plates 84, venting of the pressurized air within the cage 80 can be achieved, yet debris and fragments exiting the barrel during launching will not escape from the cage. In the event one of the removable plates is damaged or is clogged with debris, the plate can be easily removed. With the use of the removable plates 84, precise relieving pressures can be maintained which improves the operation of the launching device.

Figure 7:
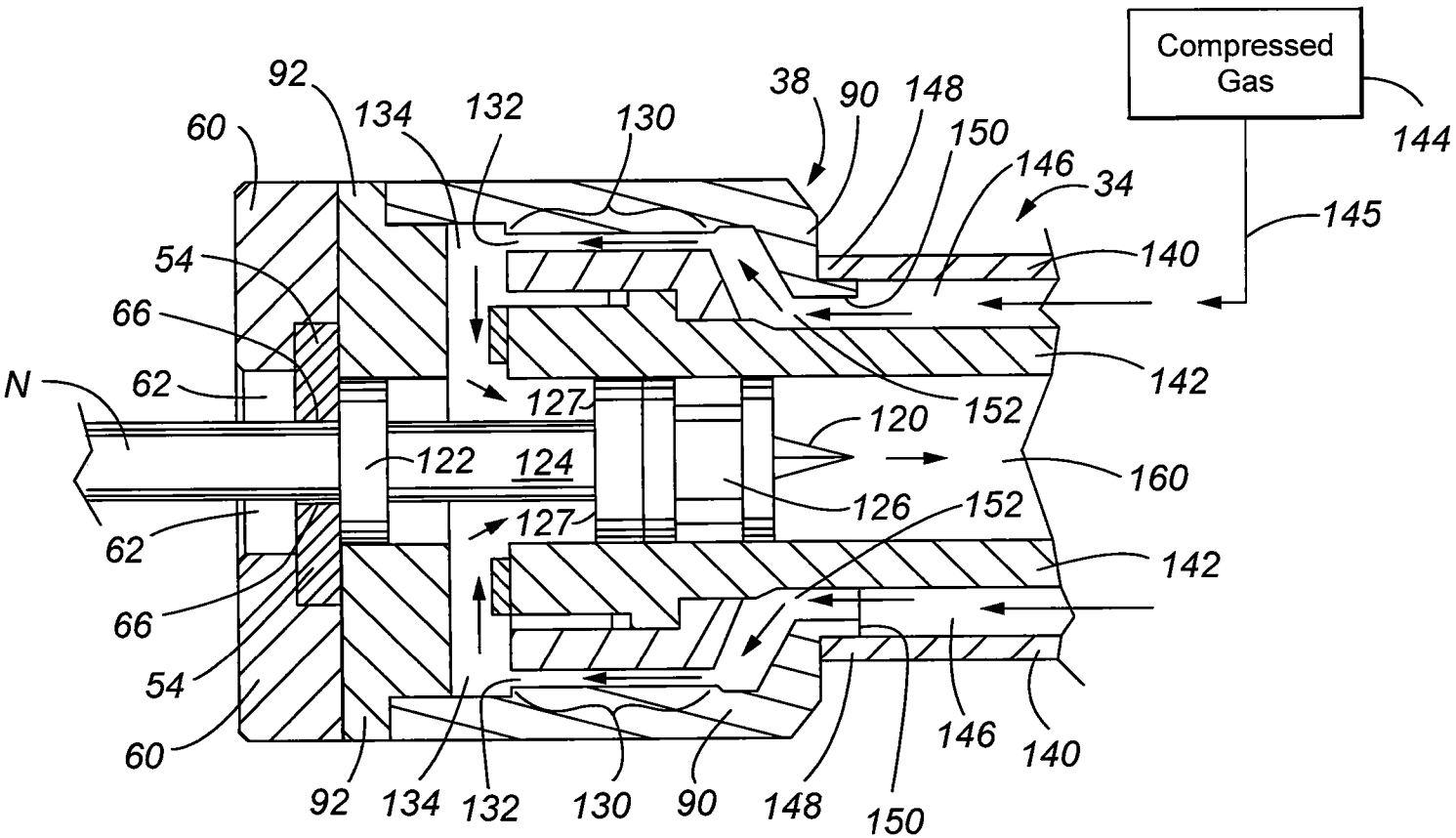
Fig. 7 Prior Art
FIG. 7 is an enlarged fragmentary cross-sectional view of the breach and barrel of a prior art soil nail launching device.

Referring to FIG. 7, the prior art breach assembly and barrel are illustrated. The barrel 34 includes a concentric arrangement of tubes, namely, an inner tube 142, and an outer tube 140. An annular space 146 is defined as the gap or space between the inner and outer tubes. A source of compressed gas 144 carried by line 145 is shown as communicating with the annular space 146 in order to pressurize the annular space. The source of compressed gas 144 may be a plurality of gas containers carried on the deployment vehicle wherein the annular space may be selectively pressurized by a pneumatic switch (not shown) controlled by the operator. The annular space is pressurized to a desired set pressure based upon how much pressure is required to launch the soil nail into the targeted area. Variations in soil density and the presence of rock will dictate the required amount of pressurization within the annular space in order to effectively launch the soil nail to a desired depth.

Figure 8:
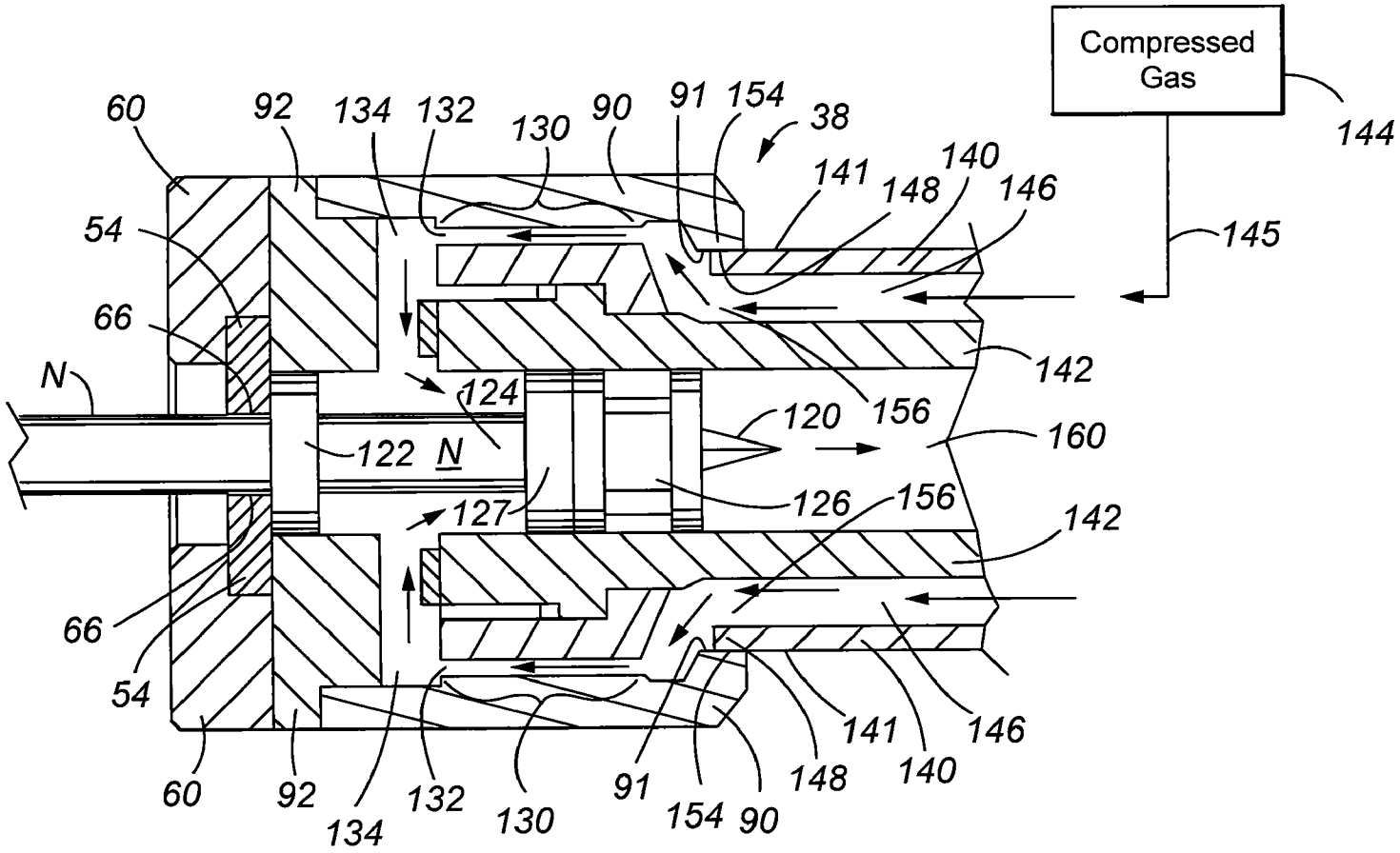
FIG. 8 is an enlarged fragmentary cross-sectional view of the improved barrel and breach of the soil nail launching device of the present invention.

The breach 38 includes a breach block housing 90, a breach block end plate 92, and a valve plate area 130. In FIG. 8, to simplify illustration of how gas is allowed to travel from the annular space 146 into the cavity 134 of the breach, in lieu of a valve plate and a plurality of valves being illustrated, the valve plate area 130 is simply illustrated as including an annular passageway 132 interconnecting the cavity 134 within the breach assembly and the annular space 146 located between the outer casing/tube 140, and the inner casing/tube 142.

FIG. 7 also illustrates a soil nail loaded through the breach into the barrel. The soil nail includes a pointed distal tip 120, a breach cap 122 which is positioned at the entrance to the breach located at the aperture 66 between the abutting edges of the breach plates, a spacer 124, and a collett/sabot 126. The collett 126 further includes a proximal flange or seal 127 such that when a soil nail is loaded, a sealed cavity exists within the breach 38 bounded by the surrounding walls of the breach, the breach cap 122, and the seal 127 of the collett 126. The collett 126 and spacer 124 are not launched into the ground, but rather are trapped within the shroud assembly and are broken into fragments as they strike an anvil secured to the base plate as mentioned below. The collett 126, spacer 124, and cap 122 are made of a plastic material while the nail is made of a high strength metal such as steel.

In the prior art design, the portion of the breach terminating at the barrel includes a flange 150. The end 148 of the outer tube 140 of the barrel is fitted over the flange 150, such as by a threaded connection. As shown, by the directional arrows, when the compressed air from the annular space 146 is allowed to travel into the breach cavity 134, it must first pass through an annular constriction 152 located at the flange 150. This constriction 152 is defined by the narrowed area between the inner tube 142 and flange 150. This constriction is smaller in area as compared to the annular space 146. Because of this constriction 152, gas cannot be evacuated from the annular space 146 as quickly as if there were no constriction there.

The basic operation of the launching device is as follows. First, the compressed source of gas 144 pressurizes the annular space 146 located between the inner and outer tubes 140 and 142. Once the annular space 146 is pressurized to the set point, then the launcher can be fired by operating valves (not shown) located at the valve plate area 130, which opens a corresponding plurality of passageways (not shown) between the cavity 134 and the annular space 146. As mentioned above, the valve plate area 130 is simplified by the illustration of the single annular passageway 132. As the cavity 134 quickly pressurizes, the soil nail is forced through the barrel as shown by the directional arrow within the bore 160 of the barrel. An o-ring shaped metallic anvil (not shown) is placed around the central opening in the base plate. The anvil has a diameter large enough to allow passage of the soil nail to enter the ground, yet the diameter of the anvil is such that the larger diameter collett strikes the anvil and breaks apart into fragments. Pressurized air is prevented from escaping the cavity 134 by the breach cap 122 that is maintained in its position as shown. The nail passes completely through the breach cap 122 and when enough pressure is relieved in the breach cavity, the breach cap may also be carried along with the spacer to the anvil where they are also fragmented by striking the anvil.

Now referring to FIG. 8 of the present invention, the flange 150 has been eliminated, and a connection is made directly between the outer surface 141 of the outer casing/tube 140 and the interior surface 91 of the breach block housing 90. By this arrangement, the constriction 152 is eliminated and area 156 defining the open space at the location of the connection between the breach and barrel has a size at least as large as the annular space 146 between the barrel tubes 140 and 142. Therefore, the annular space 146 within the barrel is able to more quickly evacuate creating greater initial pressure within the cavity 134. This greater pressure achieved within the cavity causes the soil nail to be propelled at a faster rate through the barrel. The user therefore has the option of either providing less pressure within the annular space 146 to achieve adequate penetration, or may achieve greater penetration of the soil nail with the same applied pressure as compared to the prior art.

By redesigning the connection between the breach and the barrel, improved air flow is achieved which allows a more immediate evacuation of the compressed gas into the breach chamber, thereby increasing the speed at which the soil nail can be driven into the ground. This solution is preferable over a complete redesign of the complex valve plate assembly and valving, which otherwise would be a much more complex and expensive redesign effort.

By the foregoing, it is apparent that two improvements are provided to an existing soil nail launching device to improve the overall operation and performance. These improvements are achieved without requiring a complete resign of the basic function of the soil nail launching device.

Although the foregoing invention has been shown with respect to various preferred embodiments, it should be understood that various other changes and modifications may be made within the spirit and scope of the invention.

What is claimed:

1. A device for use in soil nailing comprising:

a protective shroud;

a breach having a cavity therein;

a barrel having an inner tube, a bore and an outer tube extending through said inner tube, and an annular space between said inner and outer tubes, said barrel interconnecting said shroud and said breach;

a passageway extending from said annular space into said breach and communicating with said cavity;

a source of compressed gas to pressurize said annular space;

at least one breach plate attached to said breach, and an aperture formed in said breach plate to receive a soil nail therethrough;

said breach having an open end to receive said outer tube of said barrel;

wherein said annular space communicates with said passageway through an area of connection at said outer tube and said breach, and said annular space at said area of connection is at least as large as an area of said annular space located distally in said barrel.

2. A device for use in soil nailing comprising:

a barrel having a bore and an annular space surrounding but isolated from said bore;

a breach attached at one end of said barrel for receiving a soil nail therethrough and into said bore;

a protective shroud attached to an opposite end of said barrel;

a source of gas to pressurize the annular space in said barrel;

at least one breach plate attached to said breach and an aperture formed in said breach plate to receive a soil nail therethrough;

said shroud having a base plate contacting the ground when in use, a top plate spaced from said base plate, and a cage interconnecting said base plate and said top plate, said cage having a plurality of apertures formed therethrough;

a plurality of curved shaped shroud plates attached to an outer surface of said cage, said plates being arranged substantially parallel to one another and each plate covering a corresponding group of apertures in said cage;

a plurality of fasteners securing said plates to said cage; and wherein said plates each have opposing side edges extending closer to said outer surface of said cage then an interior portion of said plates which extend further away from said cage as compared to said opposing side edges.

3. A method of launching a soil nail through a soil nail launching device, said method comprising the steps of:

providing:

(a) a barrel having a bore and an annular space surrounding but isolated from said bore;

(b) a breach attached at one end of said barrel for receiving a soil nail therethrough and into said bore;

(c) a protective shroud attached to an opposite end of said barrel;

(d) a source of compressed gas communicating with the annular space in said barrel;

(e) at least one breach plate attached to said breach and an aperture formed in said breach plate to receive a soil nail therethrough;

(f) said shroud having a base plate contacting the ground when in use, a top plate spaced from said base plate, and a cage interconnecting said base plate and said top plate, said cage having a plurality of apertures formed therethrough;

(g) a plurality of curved shaped shroud plates attached to an outer surface of said cage, said plates being arranged substantially parallel to one another and each plate covering a corresponding group of apertures in said cage;

(h) a plurality of fasteners securing said plates to said cage; and wherein said plates each have opposing side edges extending closer to said outer surface of said cage then an interior portion of said plates which extend further away from said cage as compared to said opposing side edges;

pressurizing the annular space with the source of compressed gas;

providing a passageway in said breach enabling gas to be evacuated from said annular space through said passageway into said cavity with said breach;

forcing said soil nail through said bore of said barrel from gas pressure within the breach; and wherein said passage of said compressed air from said annular space through said passageway passes through a connection area between said breach and said barrel, and wherein an area of said annular space at said area of connection is at least as large as an area of said annular space located within the barrel and distally of said area of connection.

* * * * *